United States Patent [19]

von Platen

[11] 4,354,361

[45] Oct. 19, 1982

[54] MACHINE FOR RECOVERING ENERGY BY MEANS OF A CYCLIC THERMODYNAMIC PROCESS

[76] Inventor: Baltzar C. von Platen, Solomon Smith's Vag, Ystad, Sweden, 27 100

[21] Appl. No.: 285,761

[22] Filed: Jul. 22, 1981

[51] Int. Cl.[3] ..... F25B 3/00

[52] U.S. Cl. ..... 62/467 R; 60/649; 60/673; 62/499

[58] Field of Search ..... 62/499, 467; 60/649, 60/721, 673

[56] References Cited

U.S. PATENT DOCUMENTS 3,808,828 5/1974 Kantor ..... 62/499

3,896,635 7/1975 Stewart ..... 62/499

4,084,408 4/1978 von Platen ..... 62/467

*Primary Examiner*—Ronald C. Capossela

*Attorney, Agent, or Firm*—Eric Y. Munson

[57] ABSTRACT

The present invention provides a machine for transferring heat from a lower to a higher temperature without wasting external work. The machine includes a regulator to regulate the mean temperature of the machine by regulating the value of the lowest temperature of the machine. The regulator includes an automatically functioning instrument, and the regulation of the mean temperature of the machine to maintain it at a predetermined value provides stable operation for the machine.

16 Claims, 3 Drawing Figures

MACHINE FOR RECOVERING ENERGY BY MEANS OF A CYCLIC THERMODYNAMIC PROCESS

BACKGROUND OF THE INVENTION

The subject invention concerns a machine for producing useful work by aid of a thermodynamic process. Consequently, the disclosed machine may be called a thermal-power-machine. The most important aspect of that machine is founded on the physical and technical facts which are described in my U.S. Pat. No. 4,084,408, my English Pat. No. 1,489,415, among others. The afore-mentioned United States patent is incorporated by reference herein.

In the above disclosures, I described how heat can be compelled to pass over from a lower to a higher temperature without the wasting of external work by only complying with certain physical conditions. In other words, I described a theory of how heat of the surroundings can be converted spontaneously into useful work. For reasons of simplicity, I call this theory the Platen Effect. The apparatus used is called the Platen Machine.

In connection with the above-identified U.S. patent, I have filed a treatise entitled "*Essay for School Pupils*", which provides a basic theoretical background for the Platen Effect.

For convenience, relevant sections of my "*Essay for School Pupils*" will be repeated herein, with references to FIGS. 1 and 2 of the drawings in the present application.

Let us look at FIG. 1. There is a cylinder 1, a completely sealing and mobile piston 2 and a small quantity of liquid (ammonia, for example) 3. FIG. 2 shows a graph where the ordinate p is the gas pressure in cylinder 1 and the abscissa v is the interior volume. In the graph at point a the pressure is $p_a$ and the volume $v_a$. At points b and c, pressure and volume are $p_b$, $v_b$, $p_c$ and $v_c$ respectively.

The amount of liquid ammonia is called $q_x$; it may be reckoned in grams or numbers of molecules. Chamber 4 above the liquid contains saturated ammonia vapour. We now pump in an inert gas, for example, helium. This is a process A, which produces a rise in pressure. Everything takes place at constant temperature, for example, that of the surroundings. Now our system of liquid-vapour tries to defend itself against the rise in pressure by means of a process B. This consists of the ammonia 3 evaporating from its surface as the pressure mounts. It seems as though the evaporating ammonia molecules want to migrate into the gas-space 4 to escape the pressure of the inert gas on the surface of the liquid ammonia 3. When this migration has reduced the volume of liquid 3, the volume of gas-space 4 will have increased by the same amount. The result is that, if a quantity of inert gas, say $q_q$, is pumped in, the rise in pressure is less than it would have been if molecules had not been able to migrate into the gas-space.

But suppose the molecules are prevented from migrating, for instance, by placing a thin gold foil over the surface of liquid 3.

We must say now that the migrants' departure into the gas-space cannot possibly cause an increase in total pressure—in spite of a slight rise in partial pressure of the saturated ammonia vapour which we know occurs—since the migration is itself caused by the pressure increase, and an effect cannot augment its own cause.

Thus, the predominating effect produced in terms of Le Chatelier's principle, is the increase in volume of gas-space 4.

When we have pumped in the quantity of gas $q_q$, we find that we have arrived at point a in the graph, FIG. 2. If we had covered the liquid surface with the gold foil, we should have reached the higher point c. We see that $p_a$ is less than $p_c$ or $p_a < p_c$. The quantity of liquid $q_x$ has been chosen so that, when we reach point a, just exactly all the liquid has evaporated—that is, all its molecules have migrated.

We now push piston 2 slowly in, describing a curve to the left of point a in FIG. 2. At this point, ammonia condenses. Precisely when the previous quantity $q_x$ of liquid has been formed, or, let us say reformed, we stop piston 2. Now we find ourselves at point b. Here we cut off direct contact between liquid and gas, for instance, by laying the very thin gold foil over the liquid. We then let the piston withdraw to its first position, that is, from $v_b$ to $v_c$. Now we do not follow curve b-a, but describe b-c instead, since we have cut off contact between liquid and gas. Pressure $p_c$ is greater than $p_a$, or $p_c > p_a$, since at point c the gas mixture contains no migrants. We now remove the gold foil. Migrants leave the liquid and enter the gas. It is clear from what has already been said that, at constant volume ($v_c = v_a$), the pressure will now fall from $p_c$ to $p_a$. Thus, an amount of work equivalent to area a-b-c-a will be released, which work is analogous to perpetual motion of the second order.

When a liquid evaporates in the presence of an inert gas, evaporation heat decreases as gas pressure increases. The same is true when a vapour condenses. When condensation takes place along route a-b, the mean pressure is higher than when evaporation occurs along route c-a. Thus, more heat is taken up from the surroundings in evaporation, than is given back in condensation. This difference is work a-b-c-a expressed in units of heat.

A suitable order of magnitude for these pressures is $p_a = 100$ and $p_b = 300$ atmospheres. Even at very low pressures, this quasi-perpetual motion effect will occur, though naturally only in very slight, barely noticeable degree.

Experiments have been carried out, though unfortunately not repeated often enough, since the process seems self-evident. With $p_c = 1000$ atmospheres, it was found that $p_a$ was about 900 atmospheres. The inert gas was nitrogen and the liquid was ammonia. In a latter experiment, cylinder 1 was constructed of clear transparent plexiglass reinforced at 1 mm intervals with steel rings 1 mm thick. One could then observe how condensation took place from a to b. The liquid was propane with a trace of colouring matter added. The experiments were carried out at between one hundred and several hundred atmospheres pressure.

In my aforementioned United States patent, I claimed, inter alia, a method and apparatus for transferring heat by means of cyclic thermodynamic process in accordance with the above-discussed theory, as follows.

A method of transferring heat energy by means of a cyclic thermodynamic process comprising the steps of:

providing an axis of rotation, providing a plurality of rigid annular containers positioned adjacent one to another concentric about said axis and located at progressively greater radial distances from the axis of rotation, providing good thermal conductivity between said chambers, providing in each of said chambers a mixture of propane and an inert gas sealed therein, mounting said concentric annular chambers in an enclosing hermetically sealed static chamber closely spaced from said annular chambers for defining a narrow gap therebetween, filling said narrow gap with hydrogen, rotating said concentric annular containers at high speed about said axis, allowing heat energy to enter the innermost of said concentric annular chambers, and allowing heat energy to be released from the outermost of said chambers across said gap.

A method for transferring energy by means of a cyclic thermodynamic process comprising the steps of:

providing a medium comprising at least two substances A and B, separating substance A from substance B at a first point u′ defining a first thermodynamic parameter and allowing the medium to release energy during said separating at said first point u′.

combining substance A with substance B at a second point u″ defining a second thermodynamic parameter and which point is positioned remote from said first point u′ and allowing the medium to absorb energy during said combining at said second point u″.

providing a circulation channel for the medium between said first and second points, applying a force field to the medium for maintaining a predetermined differential in the total pressure of the medium at said first and second points, and inducing the separation and combination of the substances A and B by diffusion therebetween, whereby energy is transferred from the second point u″ to the first point u′.

Apparatus for transferring heat energy by means of a cyclic thermodynamic process comprising:

an axle mounted in bearing means and rotatable about an axis, means of high tensile strength defining a plurality of hermetically sealed rigid annular containers positioned adjacent one to another concentric about said axis and located at progressively greater radial distances from the axis of rotation, the innermost of said concentric chambers being mounted on said axle and the outermost of said chambers being encircled by a strong cylinder, said concentric chambers having good thermal conductivity therebetween in the radial direction, means thermally insulating the axial ends of said concentric chambers, said chambers having sealed therein a mixture of propane and an inert gas, means defining a hermetically sealed static chamber enclosing said axle and said concentric annular chambers, said static chamber being closely spaced about said concentric annular chambers defining a narrow gap between said static chamber and said concentric chambers, hydrogen in said narrow gap, and said axle with said concentric chambers mounted thereon being adapted to be rotated at high speeds as the rotor of a multiphase induction motor.

As more fully described in my U.S. Pat. No. 4,084,408, the Platen Machine and Platen Effect disclosed therein contemplate recovering energy by means of a cyclic thermodynamic process which is induced by means of a medium comprising at least two substances or groups of substances, one of which substances is separated from the other at a point u′ defining a first thermodynamic parameter of the medium and combined with the other one of said substances at a second point″ defining second thermodynamic parameter of the medium while the differential in total pressure of the medium is maintained between the two points. The separation and combination of the two substances are induced by diffusion whereby one of the substances or groups of substances is diffused out of the other one of the substances or groups of substances at the first point and diffused into the other substances at the second point. The method contemplates particularly the recovery of energy from a heat reservoir of lower temperature by means of a cyclic thermodynamic process and has particular application to steam engines, refrigeration plants and heat pumps for the purpose of increasing the efficiency thereof and is based upon the concept of combining two processes one of which produces work and the other one of which absorbs work.

As best disclosed starting on line 19 of Column 18 and in FIG. 15 of the aforementioned United States patent, one aspect of the Platen Machine utilizes a plurality of concentric chambers enclosed within a hermetically sealed static chamber. The concentric chambers contain, in the preferred embodiment of the invention, a mixture of propane and an inert gas, and these chambers are rotated about an axis at high speeds. Heat is presented to the innermost of the chambers and released from the outermost of the chambers across a hydrogen filled narrow gap defined between the concentric chambers and the hermetically sealed static chambers.

The above described method and apparatus is capable of receiving heat from a heat reservoir at a lower temperature and transferring the heat to an area of higher temperature for producing useful work.

SUMMARY OF THE INVENTION

My present invention relates to an improvement of the aforementioned methods and apparatus to provide stable operation in accordance with the cyclic thermodynamic process as described and claimed in my aforementioned U.S. Pat. No. 4,084,408.

In the performance of the Platen Machine in accordance with my above described theory, the machine must have a very low mean-temperature. The mean-temperature may be designated $T_m$. In a machine as described in the above discussed United States patent, two components A and B are used. The component A is chosen so that it will be suitable for the desired value of $T_m$. $T_m$ is always lower than the critical temperature $T_k$, and also lower than the highest temperature $T_1$ of the Platen Machine. That is, $T_m < T_1 < T_k$ in the aforesaid patent. However, what is not described therein is the fact that, at increasing temperature, the Platen Effect diminishes quickly, when the temperature $T_1$ approaches a certain value. This fact was discovered by me by experiments done according to the treatise "*Essay for School Pupils*" referred to and discussed herein. The equilibrium becomes unstable and the thermal-power-machine becomes technically unusable. Consequently, in order for the machine once again to become technically usable, one has to introduce a stabilizer.

Such a stabilizer may also be called a regulator, because it automatically regulates the temperature $T_1$, at which the work will be liberated. However, it is an intricate question whether one can say that it is liberated only at that particular point or in the whole Platen Machine. Because of that, it is simpler and nevertheless theoretically correct to say that the regulator regulates the mean-temperature $T_m$. It does that by regulating the energy-streams to, in and from the thermal-power machine (the Platen Machine, as disclosed in my aforementioned United States patent). Energy can stream in the form of heat, as in conduction through substance, convection, radiation, or electricity. This will be explained in the following description.

Accordingly, the present invention provides an improved machine including a regulator for regulating the mean temperature $T_m$ of the machine by regulating the temperature $T_1$ of the machine so that the machine can function in a stable mode of operation.

DETAILED DESCRIPTION OF THE DRAWINGS

Figure 1:
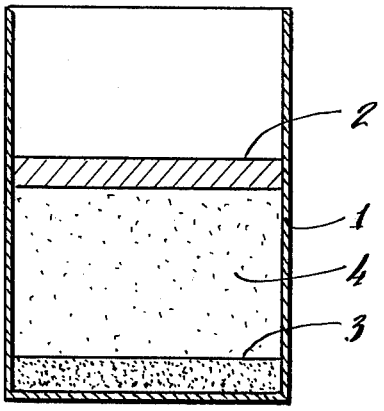
FIG. 1 illustrates a cylinder, piston and a quantity of ammonia, as discussed in the Background section hereof.
Figure 2:
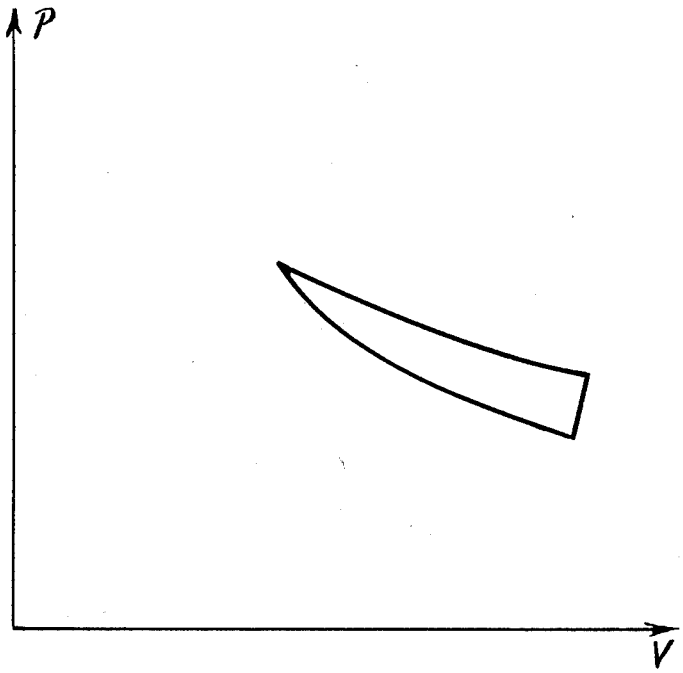
FIG. 2 illustrates a graphical representation of pressure versus volume for the system of FIG. 1.
Figure 3:
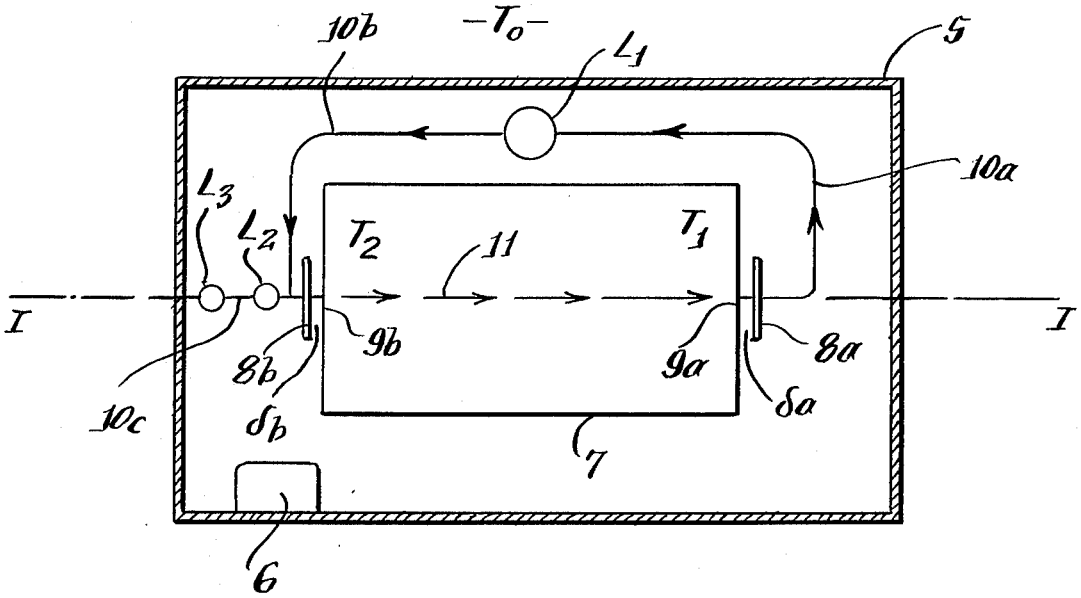
FIG. 3 illustrates an embodiment of the present invention including means for regulating the medium temperature of the disclosed Platen Machine.

FIG. 3, numeral 5, indicates a hermetically sealed housing, which can be formed of iron. Assume that there is an absolute vacuum in the housing. The vacuum is kept absolute in a known manner, namely, by the fact that in the housing a porous cartridge 6, containing, for example, vegetable coal, is positioned. The cartridge has been glowing, while a vacuum pump was working. A Platen Machine 7 is positioned within the housing 5. The structure and operation of the Platen Machine 7 is fully described and discussed in the aforementioned U.S. Pat. No. 4,084,408. In this Platen Machine, the Platen Effect is liberated. The Platen Machine 7 and the housing 5 together form the thermal-power-machine of the present invention.

Suppose that the Platen Machine 7 is rotating rapidly around the geometrical axis I—I. Bearings and other mechanical details are not shown, as the figure is schematic. Numerals 8*a* and 8*b* are two metal plates which are suitably plane. Each of them is facing its plane surface 9*a* and 9*b*. The gap between the surfaces 8*a* and 9*a* is denominated δa, and the gap between 8*b* and 9*b* is denominated δb. The lines 10*a*, 10*b* and 10*c* designate channels, through which heat can stream without resistance. Reference indices $L_1$, $L_2$ and $L_3$ denote hermetically sealed steam-engines. They may also be thermoelements. In the example shown, we have assumed that the suitable number of steam engines, $L_2$ and $L_3$ is two, but it should be understood that the number may be greater. However, at least one of these steam engines, for example, $L_2$, or thermoelements, is necessary.

Operation of my new invention will be discussed as follows.

The temperature of the surrounding environment as shown in FIG. 3 is designated $T_o$. The housing 5 has also the same temperature. In the rotating Platen Machine 7, a heat current will be generated spontaneously, i.e., without any sacrifice of energy, which current flows left to right in the figure, as shown by the arrow 11. Reference is made to my aforementioned United States patent for a description of the theoretical considerations of the Platen Machine 7. Spontaneously, a temperature difference $T_1$–$T_2$ will arise, namely, the temperature $T_1$ to the right and $T_2$ to the left of the Platen Machine 7 as indicated in FIG. 3. $T_1$ is greater than $T_2$. Heat with the temperature $T_1$ is carried off without resistance through the pipe 10*a* to the steam engine L1, where it flows into a boiler. Work is generated by the steam engine. Expressed in thermal measures, this work may be indicated as $Q_1$.

Heat from the condenser of the steam engine $L_1$ flows, without resistance, through the pipe 10*b* to the right hand portion of the pipe 10*b*, to the plate 8*b* and from there through the gap δb to the plate 9*b*, where it is seized by a force inherent in the Platen Machine 7 and spontaneously, i.e., without sacrifice of extraneous work, caused to steam in the direction from the lower temperature $T_2$ to the higher temperature $T_1$. It then continues through the columns δa and pipe 10*a* to the steam engine $L_1$, where a portion of the heat will be converted into work, which is transferred to the environment. This can be accomplished electromechanically or by means of a magnetic coupling. Both of these methods make it possible to keep the housing 5 hermetically sealed, notwithstanding the fact that the aforesaid work passes through the housing into the environment for useful application.

This work, in thermal measure is indicated as $Q_1$. This amount of heat consequently leaves the housing 5. Let us assume that this takes place per unit of time. If no heat is supplied to the housing, its temperature and consequently temperatures $T_1$ and $T_2$ will drop. The mean-temperature of the entire Platen Machine 7, which temperature ranges between $T_1$ and $T_2$, and may be designated as $T_m$, will also drop.

Now we let the heat flow through the duct 10*c* and the steamengines $L_2$ and $L_3$. The work, which these engines deliver, is transferred to the environment in the same manner as that described in connection with the machine $L_1$. All heat which flows into the housing 5 is converted into work and is passed into the environment for useful application.

We now refer to an extremely important factor.

As described in my aforementioned United States patent, the Platen Machine 7 contains two media, hereinafter referred to as medium A and medium B, respectively. It is improbable that these media, particularly medium A, can function during the entire temperature-interval from $T_o$ to $T_m$, when the $T_m$ value is low, which is desired or perhaps essential. The medium A might possibly function perfectly in a range from $T_o$=273° absolute (0° C.) to 243° absolute (−30° C.), but by using the chosen medium A, we can not further lower the temperature of the Platen Machine 7.

Because it is necessary to lower the temperature of medium A in order to increase the work which the steam-engines $L_2$ and $L_3$ deliver, the temperature of medium A is lowered by the aid of a relief-refrigerator, which is referred to as $L_h$ (not shown). Assume that in this manner the $T_m$ is lowered to 73° absolute (−200° C.). Now the media A and B, chosen for this low temperature, will function with very good results. One might also say that we choose the media A and B, particularly A, so that they are suitable for the aforementioned desired low temperatures. If we now start the steam-engines $L_2$ and $L_3$ as well as the machine $L_1$, the last-mentioned, $L_1$, assumes the function of the relief refrigerator $L_h$, which then may be stopped or disconnected.

We can now either let the entire apparatus continue in operation (possibly for decades or more), or, in the alternative, again cool down the Platen Machine by aid of the relief-refrigerator $L_h$ every time the apparatus is stopped. The latter alternative requires an electrical accumulator or a small gasoline engine. This procedure is the equivalent to the self-starting system now commonly used in connection with motor-cars. When the desired low temperature is reached, the machine $L_h$ will be disconnected.

We assume that an absolute vacuum prevails within the housing 5. All heat which is passing through the columns δa and δb consequently must pass by radiation. The radiating surfaces consequently should be rather large and be of the proper colour, preferably black. It will soon be shown how such large surfaces can be produced simply and cheaply. The columns do not necessarily have to be very small. However, they should be small when the heat is conveyed by a medium such as hydrogen at a very low pressure.

When the Platen Machine 7 rotates for long periods of time, such as years or decades, the bearings naturally must be chosen to permit this extensive use. Such bearings are the so-called Nomybearings, in which polished sledges of steel glide on a thin film of oil.

Large surfaces just mentioned can be simply produced by casting or die-casting a metal or a metal alloy. Alloys at room temperature do not have sufficient tensile strength for withstanding large centrifugal forces and high gas pressures. However, at a low temperature of about minus 200°, even mechanically weak metals become strong as high grade steel. The whole machine can be cast in such an inexpensive manner. However, in case a malfunction should develop in the system, causing the temperature to rise above a certain predetermined value, an automatically functioning mechanism can be provided to immediately discharge media A and B into the surrounding environment, or pump them into a stationary steel container which is at the temperature of the surrounding environment. The machine may not be restarted until the malfunction has been corrected and the desired low temperature $T_m$ has been once again obtained. Otherwise, the machine may burst, due to the gas-pressure or the effect of centrifugal force prevailing therein.

Just for the moment, let us assume that the machines $L_2$ and $L_3$ do not exist. Only the machine $L_1$ is delivering useful work. The lower the temperature $T_m$ is chosen, the lower will become the gas-pressure in the machine, which is an advantage, as the machine then will become lighter. Another advantage is of thermodynamical nature, which may be explained as follows.

Let us assume, for the sake of simplicity, that only one of the machines $L_2$ and $L_3$ exist, say $L_2$. According to Carnot's equation, the efficiency of this machine increases as the temperature of its condenser decreases. In other words, the lower the temperature $T_2$ (and consequently, $T_m$) is, (FIG. 3), the higher is the efficiency of the apparatus. Evidently, the whole thermal-power apparatus becomes smaller and lighter the lower the temperature $T_m$ is. However, in all probability, this is valid only within or until certain limits are reached. It is unlikely that one can construct a Platen Machine which in actual use will give a lowest temperature $T_2$ that is only a few degrees above the absolute zero point.

In order to clarify something which has been briefly mentioned hereinbefore, the following details are now given in explanation:

Let us assume that the temperature $T_m$ is optinal for a certain substance selected as medium A. If we now let $T_m$ slowly rise, we will observe that almost suddenly the Platen Effect will decrease, which means that less work will be liberated from the machine. The $T_m$ will then rapidly increase, because the heat streaming in from the surroundings will not flow in a sufficient amount back to the surroundings, due to the decreased Platen Effect. Thus, the machine will soon become inoperative, and its function can not be resumed until it has been cooled down by means of the relief-refrigerator $L_h$. Such occurance can be prevented by means of an automatic regulator as described herein. The regulator can decrease the heat-flow from the surrounding environment to the Platen Machine, or, possibly, increase the energy outflow from the steam-engines ($L_2$ and $L_3$) or from the thermoelements if the latter are used instead of steamengines. A regulator can also be used to increase the energy outflow to the surroundings from the machine $L_1$, provided, of course, that $L_1$ is not already operating at maximum capacity, i.e., receiving as much energy as the Platen Machine maximally can give it.

From the foregoing description, it should be clear that the heat-currents or, generally speaking, the energy-streams to, from and within, not only the Platen Machine 7 but within the whole thermal-power apparatus, must be regulated automatically. This is accomplished, as mentioned, by applying known natural phenomena, and regulators known at least in principle, as discussed below.

In FIG. 3, heat is conveyed through the pipes 10*a*, 10*b*, and 10*c*. This can be accomplished in the same manner as heat is conveyed from a heating boiler in a house. A steam boiler and concenser have to be placed in the proper manner and with some level difference. In the construction of the embodiment of FIG. 3, where the steam engine takes part in the rotation of the Platen Machine 7, said level difference can be very small, as, in this case, it is not the earth's gravitational field that rules, but a centrifugal-force-field which is several thousand times stronger. Valves are installed in the ducts, which valves may be regulated magnetically, by way of example, because the steam engine and the ducts have to be hermetically sealed, since they are located in an environment of absolute vacuum. Such an arrangement can easily be accomplished in several different ways, since only known phenomena and matter are applied from the steam-engine to the surroundings. Transport of energy should probably always be carried electronically. Thus, the regulator may be a simple conventional electric thermostat. The flow of heat to the housing 5 can be regulated, for example, by bimetal thermostat, since the housing is stationary.

It has been assumed herein that the Platen Machine is operating below the temperature $T_o$ of the surrounding environment. We will now also discuss the situation when it is operating above the temperature $T_o$. Let us assume that the machine shall transport heat from 20° C. to 60° C., for example. Naturally, this must be accomplished by the use of a substance A other than the substance which is suitable at a low temperature such as minus 200° C. When the rising temperature has reached 60° C. and tends to increase further, the Platen Effect will decrease if the substance A is correctly chosen for optimal function at 60° C., because we are approaching too closely the critical temperature of the substance A. In this situation, the correctly selected substance A apparently performs the same service as a regulator.

If the Platen Machine is to be used for heating a dwelling, for example, we can regulate the heat-supply to the dwelling by letting heat flow from $T_1$ to $T_2$ within the machine. That amount of heat flow can be controlled by a regulator, particularly when the heat flows through a duct. We can let it pass or not pass through a steam-engine $L_1$ or corresponding thermoelement.

One or more thermoelements or one or more steam engines may be arranged to rotate within the Platen Machine 7. Many known natural-science phenomena and many known technical instruments, apparatuses, machines and arrangements can cooperate with the Platen Machine, particularly for regulating the energy-flows to, from and within the whole thermal-power apparatus, as described herein.

I claim:

1. In a method of transferring heat energy by means of a cyclic thermodynamic process comprising the steps of:

providing axis of rotation, providing a plurality of rigid annular containers positioned adjacent one to another concentric about said axis and located at progressively greater radial distances from the axis of rotation, providing good thermal conductivity between said chambers, providing in each of said chambers a mixture of propane and an inert gas sealed therein, mounting said concentric annular chambers in an enclosing hermetically sealed static chamber closely spaced from said annular chambers for defining a narrow gap therebetween, filling said narrow gap with hydrogen, rotating said concentric annular containers at high speed about said axis, allowing heat energy to enter the innermost of said concentric annular chambers, and allowing heat energy to be released from the outermost of said chambers across said gap, the improvement comprising:

providing means for regulating the quantity of heat energy allowed to enter said innermost annular concentric chamber so that the temperature in the area where said heat energy enters said innermost chamber is prevented from rising above a predetermined value.

2. The method as claimed in claim 1 wherein said means for regulating includes a refrigeration unit selectively coupled to the area where said heat energy enters said innermost chamber and means for controlling said refrigeration unit such that said refrigeration unit is only actuated when the temperature of said area reaches said predetermined value.

3. The method as claimed in claim 1 wherein said means for regulating is a thermostat.

4. The method as claimed in claim 1 including the steps of:

providing a steam engine for supplying the heat energy allowed to enter said innermost chamber, regulating the quantity of heat energy supplied from said steam engine by disconnecting said steam engine when said temperature of said area where said heat energy enters said innermost chamber reaches said predetermined value.

5. The method of claim 1 wherein the step of providing means for regulating includes increasing the rate of heat flow from said innermost chamber to said outermost chamber when the temperature of the area in which the heat energy enters said innermost chamber reaches said predetermined value.

6. The method of claim 1 wherein the step of providing means for regulating includes increasing the quantity of heat being released from said outermost chamber when the temperature of the area in which the heat energy enters said innermost chamber reaches said predetermined value.

7. The method of claim 1 wherein said predetermined value is less than minus (−) 200° C.

8. In a method for transferring energy by means of a cyclic thermodynamic process comprising the steps of:

providing a medium comprising at least two substances A and B, separating substance A from substance B at a first point u′ defining a first thermodynamic parameter and allowing the medium to release energy during said separating at said first point u′, combining substance A with substance B at a second point u″ defining a second thermodynamic parameter and which point is positioned remote from said first point u′ and allowing the medium to absorb energy during said combining at said second point u″, providing a circulation channel for the medium between said first and second points, applying a force field to the medium for maintaining a predetermined differential in the total pressure of the medium at said first and second points, and inducing the separation and combination of the substances A and B by diffusion therebetween, whereby energy is transferred from the second point u″ to the first point u′, the improvement comprising the step of:

providing means for regulating the temperature of said second point such that said temperature does not exceed a predetermined value.

9. The method of claim 8 wherein the step of providing means for regulating includes evacuating said media A and B when the temperature of said second point reaches said predetermined value.

10. The method of claim 9 including the step of providing means for sensing when the temperature of said second point reaches said predetermined value and providing means responsive to said means for sensing to evacuate said media A and B when said temperature of said second point reaches said predetermined value.

11. The method of claim 8 wherein said step of providing means for regulating the temperature includes sslecting said media A and B such that said temperature of said second point will be maintained below said predetermined value.

12. In an apparatus for transferring heat energy by means of a cyclic thermodynamic process comprising:

an axle mounted in bearing means and rotatable about an axis, means of high tensile strength defining a plurality of hermetically sealed rigid annular containers positioned adjacent one to another concentric about said axis and located at progressively greater radial distances from the axis of rotation, the innermost of said concentric chambers being mounted on said axle and the outermost of said chambers being encircled by a strong cylinder, said concentric chambers having good thermal conductivity therebetween in the radial direction, means thermally insulating the axial ends of said concentric chambers, said chambers having sealed therein a mixture of propane and an inert gas, means defining a hermetically sealed static chamber enclosing said axle and said concentric annular chambers, said static chamber being closely spaced about said concentric annular chambers defining a narrow gap between said static chamber and said concentric chambers, hydrogen in said narrow gap, and said axle with said concentric chambers mounted thereon being adapted to be rotated at high speeds as the rotor of a multiphase induction motor, the improvement comprising:

a regulator operatively associated with said innermost chamber for regulating the temperature of the said innermost concentric chamber such that said temperature does not exceed a predetermined value.

13. An apparatus as claimed in claim 12 wherein said regulator includes a thermostat connected to said innermost chamber to prevent heat flow into said innermost chamber when the temperature thereof reaches said predetermined value.

14. An apparatus as claimed in claim 12 wherein said regulator includes a refrigerator unit coupled to said innermost chamber and temperature sensing means for activating said refrigerator unit when said predetermined temperature is sensed in said innermost chamber.

15. An apparatus as claimed in claim 12 wherein said regulator includes a steam engine connected to said innermost chamber for providing heat energy thereto and means operatively associated with said steam engine for disconnecting said steam engine from said innermost chamber when the temperature in said innermost chamber reaches said predetermined value.

16. An apparatus as claimed in claim 15 further including a second hermetically sealed static chamber for accommodating said first hermetically sealed static chamber, said first and second static chambers defining a vacuum gap therebetween, a plate positioned in said vaccum gap proximate to said innermost chamber, and means for providing heat energy from said steam engine to said plate such that heat energy received by said plate is transmitted by radiation to said innermost chamber.

* * * * *